US008609187B1

(12) United States Patent
Kang et al.

(10) Patent No.: US 8,609,187 B1
(45) Date of Patent: Dec. 17, 2013

(54) METHOD OF PRODUCING AN OXIDE DISPERSION STRENGTHENED COATING AND MICRO-CHANNELS

(75) Inventors: Bruce S. Kang, Morgantown, WV (US); Minking K. Chyu, Pittsburgh, PA (US); Mary Anne Alvin, Pittsburgh, PA (US); Brian M. Gleeson, Sewickley, PA (US)

(73) Assignee: U.S. Department of Energy, Washington, DC (US)

( * ) Notice: Subject to any disclaimer, the term of this patent is extended or adjusted under 35 U.S.C. 154(b) by 53 days.

(21) Appl. No.: 13/337,589

(22) Filed: Dec. 27, 2011

(51) Int. Cl.

| | |
|---|---|
| ***B05D 3/00*** | (2006.01) |
| ***B05D 1/12*** | (2006.01) |
| ***B05D 1/02*** | (2006.01) |
| ***B05D 7/00*** | (2006.01) |

(52) U.S. Cl.
USPC ..... 427/190; 427/191; 427/192; 427/427; 427/421.1; 427/212; 427/215; 427/216; 428/402

(58) Field of Classification Search
USPC ..... 427/180, 189–193, 195, 427, 421.1
See application file for complete search history.

(56) References Cited

U.S. PATENT DOCUMENTS

| | | | | |
|---|---|---|---|---|
| 5,372,845 | A * | 12/1994 | Rangaswamy et al. | 427/216 |
| 6,582,763 | B1 * | 6/2003 | Nishimura et al. | 427/216 |
| 6,617,003 | B1 * | 9/2003 | Lee et al. | 428/131 |
| 2005/0133121 | A1 * | 6/2005 | Subramanian et al. | 148/325 |
| 2009/0098286 | A1 * | 4/2009 | Lui et al. | 427/189 |
| 2013/0095995 | A1 * | 4/2013 | Shukla et al. | 502/5 |

FOREIGN PATENT DOCUMENTS

WO WO2010136777 * 12/2010

OTHER PUBLICATIONS

Stein et al., "Mechanofusion for High Performance Particles", Process Engineering, p. 3.*
Kang et al., "Materials and Component Development for Advanced Turbine Systems—ODS Alloy Development," Presentation to 23rd Annual Conference on Fossil Energy Materials, Pittsburgh, May 12-14, 2009.
Kang et al., "Materials and Components Development for Advanced Turbine Systems—ODS Alloy Development," 23rd Annual Conference on Fossil Energy Materials, Pittsburgh, May 12-14, 2009.

* cited by examiner

*Primary Examiner* — Frederick Parker
*Assistant Examiner* — Ann Disarro
(74) *Attorney, Agent, or Firm* — James B. Potts; Jacob Heafner; John T. Lucas

(57) ABSTRACT

The disclosure provides a method for the production of composite particles utilizing a mechano chemical bonding process following by high energy ball milling on a powder mixture comprised of coating particles, first host particles, and second host particles. The composite particles formed have a grain size of less than one micron with grains generally characterized by a uniformly dispersed coating material and a mix of first material and second material intermetallics. The method disclosed is particularly useful for the fabrication of oxide dispersion strengthened coatings, for example using a powder mixture comprised of $Y_2O_3$, Cr, Ni, and Al. This particular powder mixture may be subjected to the MCB process for a period generally less than one hour following by high energy ball milling for a period as short as 2 hours. After application by cold spraying, the composite particles may be heat treated to generate an oxide-dispersion strengthened coating.

20 Claims, 8 Drawing Sheets

PRIOR ART

METHOD OF PRODUCING AN OXIDE DISPERSION STRENGTHENED COATING AND MICRO-CHANNELS

GOVERNMENT INTERESTS

The United States Government has rights in this invention pursuant to the employer-employee relationship of the Government to the inventors as U.S. Department of Energy employees at the National Energy Technology Laboratory, and pursuant to contract DE-AC26-04NT41817.

FIELD OF THE INVENTION

The disclosure relates to the production of composite particles utilizing a mechano chemical bonding process following by high energy ball milling on a powder mixture comprised of coating particles, first host particles, and second host particles. The method disclosed is particularly useful for the fabrication of oxide dispersion strengthened coatings, for example using a powder mixture comprised of $Y_2O_3$, Cr, Ni, and Al. Following application by cold spraying, the composite particles may be heat treated to generate an oxide-dispersion strengthened coating.

BACKGROUND

Mechanical alloying is a solid-state powder processing technique involving repeated cold welding, fracturing, and re-welding of powder particles in a high-energy ball mill. Mechanical alloying is capable of synthesizing a variety of equilibrium and non-equilibrium alloy phases starting from blended elemental or pre-alloyed powders, and finds particular application in the production of oxide-dispersion strengthened nickel- and iron-base superalloys. The basic mechanism of mechanical alloying is repeated deformation, fracture and cold welding by high energetic ball collisions. Depending on the dominant process during milling, such as fracturing, welding or micro-forging, a particle may become smaller through fracturing or may grow through agglomeration. It is a means for producing composite metal powders with controlled, extremely fine microstructures, and can be used to produce alloys that are difficult or impossible to produce by conventional melting and casting techniques.

Mechanical alloying typically begins by blending individual powder constituents which may have diameters ranging from 1 to 500 μm. Additional constituents may include powdered intermetallic compounds. Initial ball-powder-ball collision causes the ductile metal-powders to flatten and work harden, and severe plastic deformation increases the particle's surface-to-volume ratio and ruptures the surface films of adsorbed contaminants. More brittle constituents are more severely comminuted. At the completion of the mechanical alloying process the powder particles generally have an extremely deformed metastable structure and may include dispersoids of the brittle material, depending on initial powder composition.

Mechanical alloying is used to produce coating feedstock because of the ease with which a fine admixture of constituents can be formed, including relatively homogeneous dispersions of refractory oxides. As a result, mechanical alloying lends itself to the fabrication of oxide-dispersion strengthened (ODS) alloys. ODS alloys utilize yttrium oxide evenly distributed throughout the matrix to maintain strength at higher temperatures than conventional superalloys, and have been under intensive development over the past four decades. However, a key factor that limits their wide usage is the high manufacturing cost. The dissolution of $Y_2O_3$ is difficult and requires a long time of milling, and insufficient dissolution of yttrium oxide will lead to an inhomogeneous microstructure even after post-mill processing. Generally, milling times in excess of 60 hours are necessary in order to generate adequate yttrium oxide dispersion. See e.g., Klueh et al., "Oxide dispersion-strengthened steels: A comparison of some commercial and experimental alloys," *Journal of Nuclear Materials*, Vol. 341 (2-3) (2005); see also Zbiral, "Tensile Properties of Mechanically Alloyed/Milled ODS-Ni-Based Alloys," *Metallurgical and Materials Transactions A*, Vol. 27A (1996), among others. It would be advantageous to provide a process whereby a small grain, composite particle comprised of intermetallics and strengthening dispersoids could be generated with significant reduction of necessary milling times. It would be particularly advantageous if milling times necessary for the fabrication of ODS alloys were effectively reduced. Additionally, most mechanically alloyed powders are consolidated by hot compaction followed by hot extrusion, or by direct hot extrusion at temperatures greater than half of their melting point, and the extruded bars are then thermomechanically processed to desired grain structures or cold rolled to sheet. It would be additionally advantageous to provide a fabrication process whereby composite particles generated by a reduced milling time could be applied and consolidated through spray application followed by heat treatment. Such an application technique would greatly mitigate the processing steps generally required between production of ODS composite particles and the final state of an oxide-dispersion strengthened alloy.

Additional challenges associated with ODS alloys involve general shaping and joining concerns. Because ODS alloys are usually manufactured by mechanical alloying followed by hot-extrusion or hot isostatic pressing, these alloys are mostly fabricated as massive pieces, and large scale ODS superalloy sheets are very difficult to obtain by rolling due to the poor ductility of ODS alloys. Additionally, joining techniques which preserve the microstructure and intrinsic strength of ODS alloys are severely limited, which limits their ability to be incorporated into load bearing structures. Fusion welding, commonly used for metals, is not ideal for ODS alloys because melting disrupts both the fine, uniform dispersion of nano-sized oxide particles and the coarse grain structure of recrystallized ODS alloys. This limits the extent to which ODS alloys can be joined in order to generate geometric features that might be advantageous, such as cooling channels in a high temperature turbine vanes, among others. It would be advantageous to provide composite particles that could be applied in a manner such that internal features could be constructed using a removable fugitive phase in conjunction with cold spray application, so that such internal features could be fabricated without dependence on strength-impacting joining technologies.

Provided here is a method for the fabrication of small grain, composite particles comprised of intermetallics and strengthening dispersoids providing a significant reduction in necessary milling times. The methodology has particular applicability to the production of ODS composite particles. Additionally, the fabrication methodology provides composite particles suitable for cold spray application followed by heat treatment, greatly mitigating the processing steps typically employed between composite particle production and final fabrication. Additionally, the methodology allows construction of internal features using a removable fugitive phase in conjunction with cold spray application, so that such internal features can be fabricated without dependence on strength-impacting joining technologies.

These and other objects, aspects, and advantages of the present disclosure will become better understood with reference to the accompanying description and claims.

SUMMARY

The method disclosed here utilizes a mechano chemical bonding (MCB) process following by ball milling on a powder mixture comprised of coating particles, first host particles, and second host particles in order to generate composite particles having a grain size of less than one micron. Within the powder mixture, the coating particles have a representative diameter of 50 nanometers (nm) or less, while the first host particle and the second host particle have representative diameters of from about 1 micron (μm) to about 50 μm.

The methodology utilizes the initial MCB process to form a thin film of the coating material on the first host particles and the second host particles, forming coated host particles. The coated host particles are then subjected to high energy ball milling for a sufficient time to form composite particles. The composite particles formed have a grain size of less than one micron, where the grains are generally characterized by a uniformly dispersed coating material and a mix of first material and second material intermetallics.

The method disclosed is particularly useful for the fabrication of oxide dispersion strengthened coatings. In certain embodiments, the powder mixture is initially formulated such that the composite particles are ODS composite particles, and the ODS composite particles are applied to a substrate using a cold spray technique. Subsequent heat treating forms the oxide dispersion strengthened coating. The ODS composite particles maintain their grain structure during the cold spray process and the oxide dispersion strengthened coating may be produced with a minimum of ball milling and without necessary hot rolling. In a particular embodiment, the coating material is yttrium-oxide ($Y_2O_3$), the first material is chromium (Cr), and the second material is nickel (Ni). In this embodiment, the powder mixture is further comprised of aluminum (Al) particles having a representative diameter between 1 to 50 μm. This particular powder mixture may be subjected to the MCB process for a period generally less than one hour following by high energy ball milling for a period as short as 2 hours. After application by cold spraying, the composite particles may be heat treated to generate an oxide-dispersion strengthened coating.

The oxide dispersion-strengthened coating thus formed may act as a structural layer in concert with an underlying substrate, allowing feasible fabrication of cooling channels within the oxide dispersion-strengthened coating. The cooling channels may be formed through the use of a fugitive phase prior to the cold spray process, and removal of the fugitive phase following the heat treatment. Application of this particular embodiment through cold spray provides significant advantage over typical fabrication methodologies associated with nickel-based oxide dispersion-strengthened coatings.

The method thus provides for the fabrication of small grain, composite particles comprised of intermetallics and strengthening dispersoids in a manner providing significant reduction in necessary fabrication times, with particular applicability to the production of ODS composite particles. Additionally, the fabrication methodology provides composite particles suitable for cold spray application followed by heat treatment, greatly mitigating the processing steps typically employed between composite particle production and final fabrication. Additionally, the methodology allows construction of internal features using a removable fugitive phase in conjunction with cold spray application, so that such internal features can be fabricated without dependence on strength-impacting joining technologies.

These and other objects, aspects, and advantages of the present disclosure will become better understood with reference to the accompanying description and claims.

DETAILED DESCRIPTION

Figure 1:
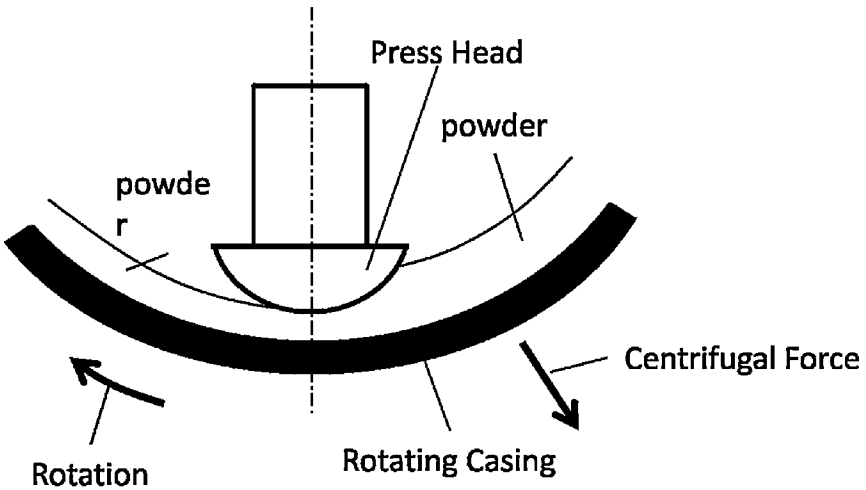
FIG. 1 illustrates an exemplary mechano chemical bonding process.

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide a method for the production of composite particles having a grain size of less than one micron, where the grains are generally characterized by a uniformly dispersed coating material and a mix of first material and second material intermetallics, and a method for the application of such produced composite particles using cold spray apparatus.

The method disclosed here utilizes a mechano chemical bonding (MCB) process following by ball milling on a powder mixture comprised of coating particles, first host particles, and second host particles, where the particles consist of a coating material, a first material, and a second material respectively, where the first material and the second material are comprised of metals. The coating particles have a representative diameter of 50 nm or less, while the first host particle and the second host particle have representative diameters of from about 1 μm to about 50 μm. The MCB process acts to form a thin film of the coating material on the first host particles and the second host particles, thus forming coated host particles. The coated host particles are then subjected to high energy ball milling for a sufficient time to form composite particles. The composite particles formed have a grain size of less than one micron, where the grains are generally characterized by a uniformly dispersed coating material and a mix of first material and second material intermetallics.

The method disclosed is particularly useful for the fabrication of oxide dispersion strengthened coatings. In certain embodiments, the powder mixture is initially formulated such that the composite particles are ODS composite particles, and the ODS composite particles are applied to a substrate using a cold spray technique. Subsequent heat treating forms the oxide dispersion strengthened coating. The ODS composite particles maintain their grain structure during the cold spray process and the oxide dispersion strengthened coating may be produced with a minimum of ball milling and without necessary hot rolling. In a particular embodiment, the coating material is $Y_2O_3$, the first material is Cr, and the second material is Ni. In this embodiment, the powder mixture is further comprised of Al particles having a representative diameter between 1 to 50 μm. This particular powder mixture may be subjected to the MCB process for a period generally less than one hour following by high energy ball milling for a period as short as 2 hours. The resulting ODS composite particles are comprised of sub-micron grains generally characterized by uniformly dispersed $Y_2O_3$ inside the grains acting as barriers to dislocation motion, and a mix of precipitate strengthened Cr and Ni intermetallics. Subsequent cold spray and heat treatment on a substrate forms a nickel-based oxide dispersion-strengthened coating. Further, this nickel-based oxide dispersion-strengthened coating may act as a structural layer in concert with the underlying substrate, allowing feasible fabrication of cooling channels within the oxide dispersion-strengthened coating. The cooling channels may be formed through the use of a fugitive phase prior to the cold spray process, and removal of the fugitive phase following the heat treatment. Application of this particular embodiment through cold spray provides significant advantage over typical fabrication methodologies associated with nickel-based oxide dispersion-strengthened coatings.

The powder mixture comprised of the coating particles, first host particles, and second host particles may be further comprised of minor particles. During the MCB process, the minor particles may adhere to the first and second host particles, or to the thin film of coating material generated.

Within this disclosure, the term "powder mixture" means a mixture comprised of a plurality of coating particles, a plurality of first host particles, and a plurality of second host particles, where an individual particle in the pluralities consists of the coating material, the first material, or the second material. Additionally, the plurality of coating particles have a representative diameter of 50 nm or less, the plurality of first host particles has a representative diameter of from about 1 μm to about 50 μm, and the plurality of second host particles has a representative diameter of from about 1 μm to about 50 μm. In an embodiment, the coating material is $Y_2O_3$, the first material is Cr, and the second material is Ni.

Within this disclosure, the term "representative diameter" means a diameter based on replacing a given particle with an imaginary sphere having a property identical with the particle, and includes volume based particle size, weight based particle size, area based particle size, and hydrodynamic/aerodynamic particle size definitions. The representative diameter will typically refer to an average particle size in the particle size distribution of a polydisperse plurality of particles, and may include discrete size ranges within the plurality. The representative diameter may be determined through laser diffraction methods, sieve analysis, optical granulometry, electron micrograph, or other means known in the art. Typically, the requirements of this disclosure with respect to representative diameter specifications will be met through a sizing specification provided by a manufacturer of powder particles, where the manufacturer provides size data based on one of the methods delineated above and executed in accordance with ISO or other standardizing bodies.

Within this disclosure, the term "coated host particles" means a plurality of first host particles and a plurality of second host particles, where the particles in each plurality are individually surrounded by a thin film of coating material originating from the coating particles. Coated host particles as defined herein may additionally include minor particles which may be introduced into the powder mix.

Within this disclosure, the term "composite particles" means a plurality of particles having a representative diameter of from about 20 microns to about 100 microns, where the composite particles have a grain size of less than one micron, with coating material originating from the coating particles dispersed within the grain boundaries and an intermetallic of the first material and the second material within the grains. Within this disclosure, the term "ODS composite particle" means a composite particle fabricated from a powder mixture where the coating material is an oxide of yttria, zirconium, thorium, titanium, calcium, aluminium or hafnium, and where the first or second material is nickel, chromium, cobalt, or iron. In an embodiment where the coating material is $Y_2O_3$, the first material is Cr, and the second material is Ni, the resulting ODS composite particles are comprised of sub-micron grains generally characterized by uniformly dispersed $Y_2O_3$ inside the grains acting as barriers to dislocation motion, and a mix of precipitate strengthened Cr and Ni intermetallics.

Within this disclosure, the term "intermetallic" means a material formed when the first host particles and the second host particles are subjected to high energy ball milling and react to produce a solid phase that is distinctively different from the constituent elements comprising the first material and the second material. The first material and the second material comprising the first host particles and the second host particles respectively diffuse into one another creating the intermetallic as a combination of the first and second materials. The diffusion is generally enabled by the movement of atoms of one material into the crystal vacancies of the other material.

The coating material is generally an oxide compound comprised of a metal and oxygen, such as the oxides of yttria, zirconium, thorium, titanium, calcium, aluminium and hafnium discussed supra, however the use of other coating materials is envisioned within this disclosure. Other materials suitable for use as coating materials include but are not limited to carbides, borides, silicides, nitrides, silicates, and combinations thereof. Preferably the coating material is less ductile than either the first or second materials comprising the first host particles and the second host particles respectively. However, the specific composition of the coating material, the first material, or the second material is not limiting within this disclosure, provided that the coating particles have a representative diameter of 50 nm or less, and the first host particles and second host particles have a representative diameter of from about 1 μm to about 50 μm.

The methodology disclosed is generally comprised of preparing a powder mixture comprised of the coating particles, the first host particles, and the second host particles having represented diameters as specified. The powder mixture is then subjected to an MCB process for an MCB time period, where the MCB time period is sufficient to generate the coated host particles. The sufficiency of the MCB time period may be evaluated by X-ray Diffraction (XRD), Transmission Electron Microscopy (TEM), or other means known in the art. The coated host particles are then subjected to a high energy ball milling process for a ball milling time period sufficient to produce composite particles, where the composite particles have a representative diameter of from about 20 μm to about 100 μm, and where the composite particles have a grain size of less than one micron. In certain embodiments, the MCB time period and the ball milling time period are specified, however the duration of the MCB time period and the ball milling time period are not strict limitations within this disclosure. Within this disclosure, it is only necessary that the MCB process precede the high energy ball milling process, and that the respective processes are conducted until the products as described result. This particular sequence of operation generates composite particles having desired characteristics with significantly less high energy ball milling than is typically employed. The method as disclosed here thus provides significant advantage in the fabrication of composite particles, and particularly ODS composite particles.

Preparing the Powder Mixture:

The powder mixture is comprised of a plurality of coating particles, a plurality of first host particles, and a plurality of second host particles, where the plurality of coating particles have a representative diameter of 50 nm or less, the plurality of first host particles has a representative diameter of from about 1 μm to about 50 μm, and the plurality of second host particles has a representative diameter of from about 1 μm to about 50 μm. The powder mixture may be further comprised of one or more pluralities of minor particles. In a particular embodiment where the composite particles are ODS composite particles as defined herein, the coating particles are $Y_2O_3$, the first host particles are Cr, the second host particles are Ni, and the powder mixture is further comprised of minor particles of Al and tungsten (W).

The representative diameter is a geometric delineation of particle size describing a volume based particle size, a weight based particle size, an area based particle size, or a hydrodynamic/aerodynamic particle size as discussed herein, and will typically refer to an average particle size in a polydisperse plurality of particles. Typically, the representative diameter specifications of this disclosure will be met through a sizing specification provided by a manufacturer of powder particles, where the manufacturer provides size data based on one of the methods delineated above and executed in accordance with ISO or other standardizing bodies. In an embodiment, coating particles of $Y_2O_3$ with a representative diameter less than 50 nm were obtained from Sigma Aldrich Inc., St. Louis, Mo.; first host particles of Cr with a representative diameter between 7.5-10 μm were obtained from F.W. Winter & Co., Camden, N.J.; and second host particles of Ni with a representative diameters of between 4-8 μm were obtained from Alfa Aesar, Ward Hill, MA. The representative diameters as listed were based on sizing specifications provided by the respective manufacturers. Additionally, the powder mixture was comprised of Al particles between 4.5-7 μm and W particles of approximately 1 μm.

The powder components are weighted according to a desired composition using means known in the art. For example, in an embodiment generating ODS composite particles, the powder mixture is comprised of from about 0.5 weight percent to about 5 weight percent $Y_2O_3$ coating particles, from about 10 weight percent to about 30 weight percent Cr first host particles, and from about 50 weight percent to about 90 weight percent Ni second host particles, with about 1 weight percent to about 10 weight percent Al particles as minor particles. In a further embodiment, the powder mixture is comprised of from about 0.5 weight percent to about 2 weight percent $Y_2O_3$ coating particles, from about 15 weight percent to about 25 weight percent Cr first host particles, and from about 60 weight percent to about 80 weight percent Ni second host particles, with about 3 weight percent to about 7 weight percent Al particles as minor particles.

The coating particles, the first host particles, the second host particles, and any minor particles may be Mended using means known in the art prior to subjecting the powder mix to the subsequent MCB process. Alternatively, blending of the coating particles, the first host particles, the second host particles, and any minor particles may occur during the subsequent MCB process.

Generating a Coating on the First and Second Host Particles:

The coating is generated on the first host particles and the second host particles using an MCB process, generating coated host particles. The MCB process is a dry mechanical combining technique for applying mechanical energy to different material particles to cause a mechanochemical reaction. As is understood, application of certain kinds of mechanical energy to pluralities of different material particles may generate surface fusion. This represents a simpler process than other particle combining processes, such as wet processes, and is advantageous in having a much wider range of combinations. Thus the term "mechano chemical bonding" means a process engendering chemical interaction of a solid in its highly excited state with surrounding substances under application of mechanical energy.

An exemplary MCB process which may generate the mechano chemical bonding utilized within this disclosure is illustrated generally at FIG. 1. The unit contains a press head and rotating casing, inside of which powder is supplied. Generally and without being bound by theory, the casing rotation causes the powder to migrate to the inside wall of the high-speed rotating casing, generating compression and friction, and resulting in extremely brief and local temperature peaks which extend into the range of sintering temperatures at particle contact points. The powder layer is then mechanically compressed as the press head passes over it and forces the powder through a narrow gap. At the same time, the powder layers slide and roll against each other within the highly dense material bed, causing the mechanical energy to be transferred to the contact points of the particles. By this principle solid-solid composite materials can be produce in a dry process without the use of a binder by only applying mechanical force. See e.g., Tenhover et al., "Mechanofusion for High Performance Particles," *Process Eng.,* 79 [4] (2002). A particular machine adaptable for carrying out the steps of the method disclosed herein is the "Mechano Fusion System" available from the Hosokawa Micron Group, 10 Chatham Road, Summit, N.J.

Within the methodology, the MCB process is conducted on the powder mixture for an MCB time period, where the MCB time period is sufficient to form a thin film of coating material on the first and second host particles. At the representative diameters specified, the thin film of coating material will generally be between 10-100 nm. The thin film is generally comprised of an amorphous phase of the coating material, and the sufficiency of the MCB time period may be determined by any suitable method. For example, XRD techniques may be utilized when the coating particles exhibit a crystalline structure. In an embodiment, the sufficiency of the MCB time period is determined based on the substantial absence of an XRD intensity peak at the coating particle 2-theta value when the coated host particles are analyzed by XRD, as compared to an XRD analysis of the coating particles alone, or as compared to an XRD analysis of the powder mixture prior to commencing the MCB process.

Figure 2:
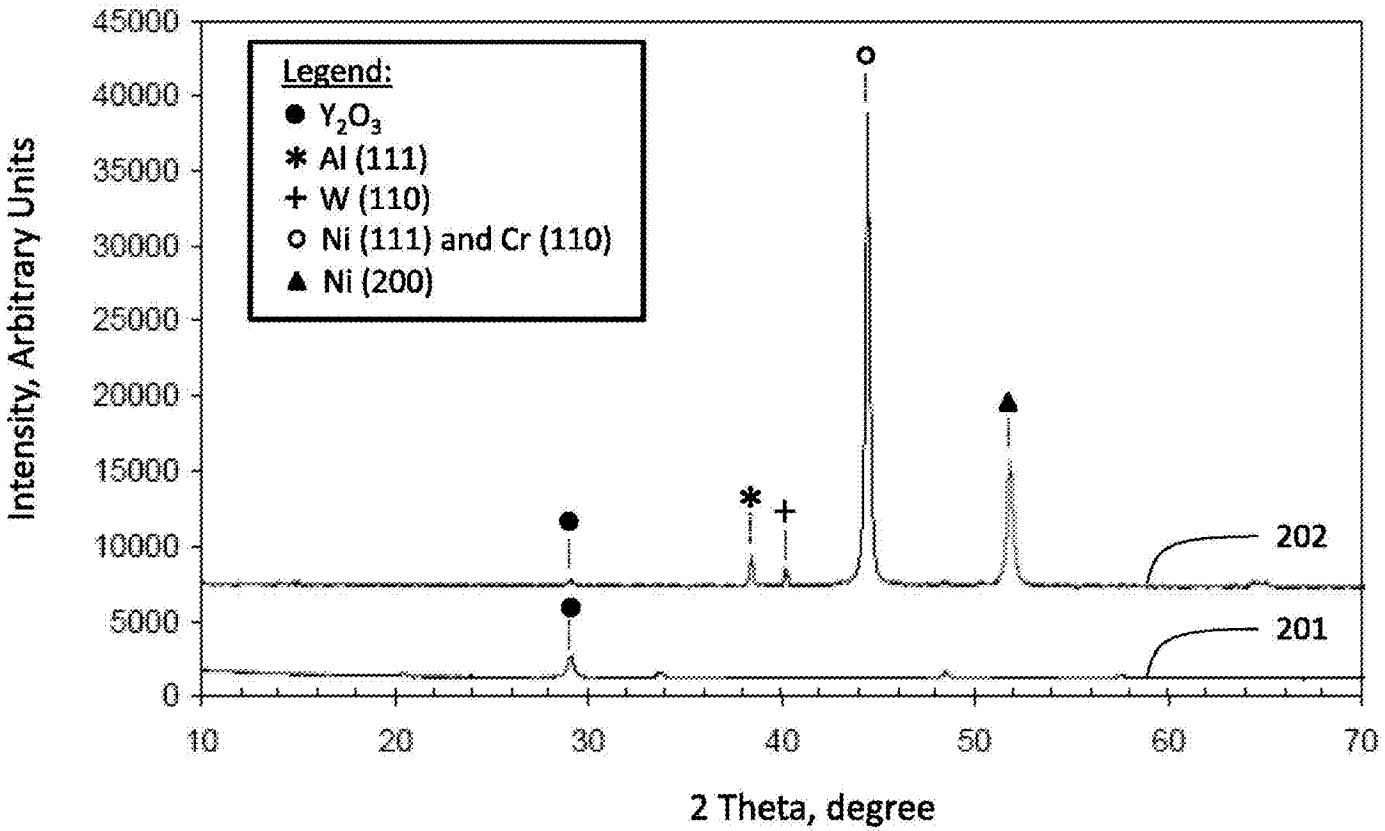
FIG. 2 illustrates an XRD analysis of coated host particles generated by the methodology.

For example, FIG. 2 illustrates an XRD analysis conducted on a powder mixture comprised of coating particles of $Y_2O_3$, first host particles of Cr, and second host particles of Ni, with representative diameters of less than 50 nm for the $Y_2O_3$ particles, between 7.5-10 μm for the Cr particles, and between 4-8 μm for the Ni particles. Additionally, the powder mixture was comprised of All and W particles between 4.5-7 μm. At FIG. 2, trace 201 represents the XRD pattern of the $Y_2O_3$ particles prior to generating the powder mixture, and reflects the XRD intensity peak associated with $Y_2O_3$ as indicated. Trace 202 represents the XRD pattern generated after subjecting the powder mixture to an MCB process for an MCB time period sufficient to form a thin film of $Y_2O_3$ around the Cr and Ni particles. As indicated, trace 202 reflects XRD intensity peaks associated with Cr, Ni, Al, and W, and illustrates a substantial absence of the $Y_2O_3$ intensity peak. The presence of the host particle Cr and Ni intensity peaks and the substantial absence of the $Y_2O_3$ intensity peak indicates the formation of a thin film of $Y_2O_3$ surrounding the Cr and Ni particles, and indicates that the MCB process has been conducted for a sufficient MCB time period. In this particular case, the MCB process was conducted with the "Mechano Fusion System" generally discussed above for an MCB time period of approximately 30 minutes.

Here, the term "substantial absence" with respect to the coating particle XRD intensity peak means an XRD intensity peak which is either undetectable above background, or which reflects an intensity peak decrease of some percentage at the coating particle 2-theta value, when compared to the XRD analysis of the coating particles alone or the powder mixture prior to the MCB process. For example, a substantial absence may mean that an XRD analysis of the coated host particles following an MCB process for the MCB time period indicates a post MCB XRD intensity peak at the coating material 2-theta less than 70% of the XRD intensity peak indicated by the coating particles alone prior to the MCB process, where the intensity peak is the intensity above background, and where the intensity peaks compared may be height based intensities or area based intensities. Preferably, the post MCB XRD intensity peak decreases at least 90%. The substantial absence of the previously present coating particle crystalline structure serves as indication that a thin, generally amorphous film of coating material has formed around the host particles.

Figure 3:
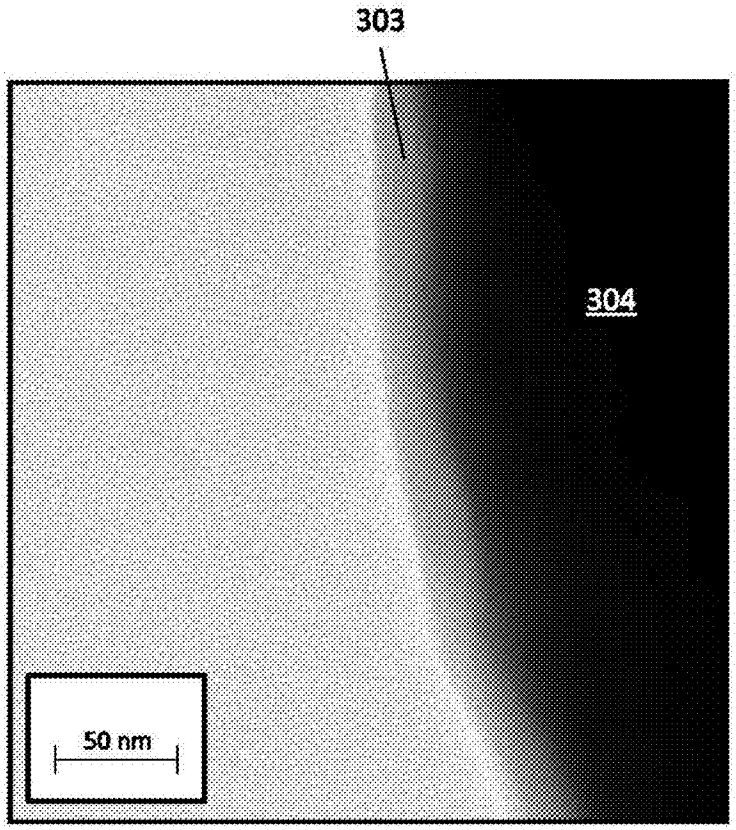
FIG. 3 illustrates a TEM analysis of coated host particles generated by the methodology.

Alternatively, the establishment of a thin film of coating material around the first and second host particles may be indicated using a visual means such as, for example, TEM analysis, which provides a direct observation of the thin film of coating material around the first and second host particles. FIG. 3 illustrates a TEM micrograph illustrating a thin film 303 of approximately 25 nm thickness surrounding a host particle 304 following an MCB process for a sufficient MCB time period. At FIG. 3, the thin film 303 and host particle 304 may be differentiated by contrast. However, the manner in which the thin film of coating material is verified, indicating that the MCB process has occurred for a sufficient MCB time period, is not limiting within this disclosure. Within this disclosure, it is only necessary that a powder mixture comprised of coating particles less than 50 nm, first host particles between 1-50 μm, and second host particles between 1-50 μm, be subjected to an MCB process for an MCB time period, where the MCB time period is sufficient to generate a film of the coating material around the first and second host particles.

The MCB time period necessary to generate the coated host particles is generally less than 2 hours, and may be as short as thirty minutes. However, the specific length of the MCB time period is generally not limiting within this disclosure, provided that the MCB time period is sufficient to produce coated host particles comprised of a plurality of first host particles and a plurality of second host particles, where the particles in each plurality are individually surrounded by a thin film of the coating material, where the coating material originates from the coating particles in the powder mixture. Additionally, it is understood that although XRD and TEM methodologies may be utilized to verify the establishment of the thin film of coating material around the first and second host particles, other suitable means may be employed, including previous experience based on powder mixtures of equivalent or similar composition.

Subjecting the Coated Host Particles to a High Energy Ball Milling Process:

The coated host particles generated by the MCB process are subjected to a high energy ball milling process for a ball milling time period sufficient to produce composite particles, where the composite particles have a representative diameter of from about 20 microns to about 100 microns, and where the composite particles have a grain size of less than one micron. The composite particles are generally comprised of coating material originating from the coating particles dispersed within the grain boundaries, and an intermetallic of the first material and the second material within the grains. In an embodiment where the coating material is $Y_2O_3$, the first material is Cr, the second material is Ni, and the composite particles are ODS composite particles as defined herein, the ODS composite particles are comprised of sub-micron grains generally characterized by uniformly dispersed $Y_2O_3$ inside the grains acting as barriers to dislocation motion, and a mix of precipitate strengthened Cr and Ni intermetallics.

The high energy ball milling of the coated host particles is carried out in a high energy ball mill by charging the drum of the mill with the coated host particles and processing the powders within the mill. Suitable high energy ball mills include attritor mills, ball mills, and the like. Preferably, the drum of the high energy ball mill is stationary and contains rotating impellers which impact the balls contained therein, thereby setting the balls into essentially random motion within the drum. Through the random motion of the balls contained within the drum, the coated host particles are agitated with sufficient force to form the composite particles. High energy ball milling apparatus suitable for the generation of composite particles as disclosed here are known in the art. Preferably, high energy ball milling is conducted in an attritor mill. Exemplary attritor mills are described in U.S. Pat. No. 3,591,362 to Benjamin and U.S. Pat. No. 5,631,044 to Rangaswamy et al., among others.

The high energy ball milling process is conducted for a ball milling time period sufficient to produce the composite particles as described, where the composite particles have a representative diameter of from about 20 microns to about 100 microns, and where the composite particles have a grain size of less than one micron. The sufficiency of the ball milling time period may be evaluated by any suitable method, for example, by XRD techniques in combination with particle sizing techniques known in the art, such as those discussed earlier.

Figure 4:
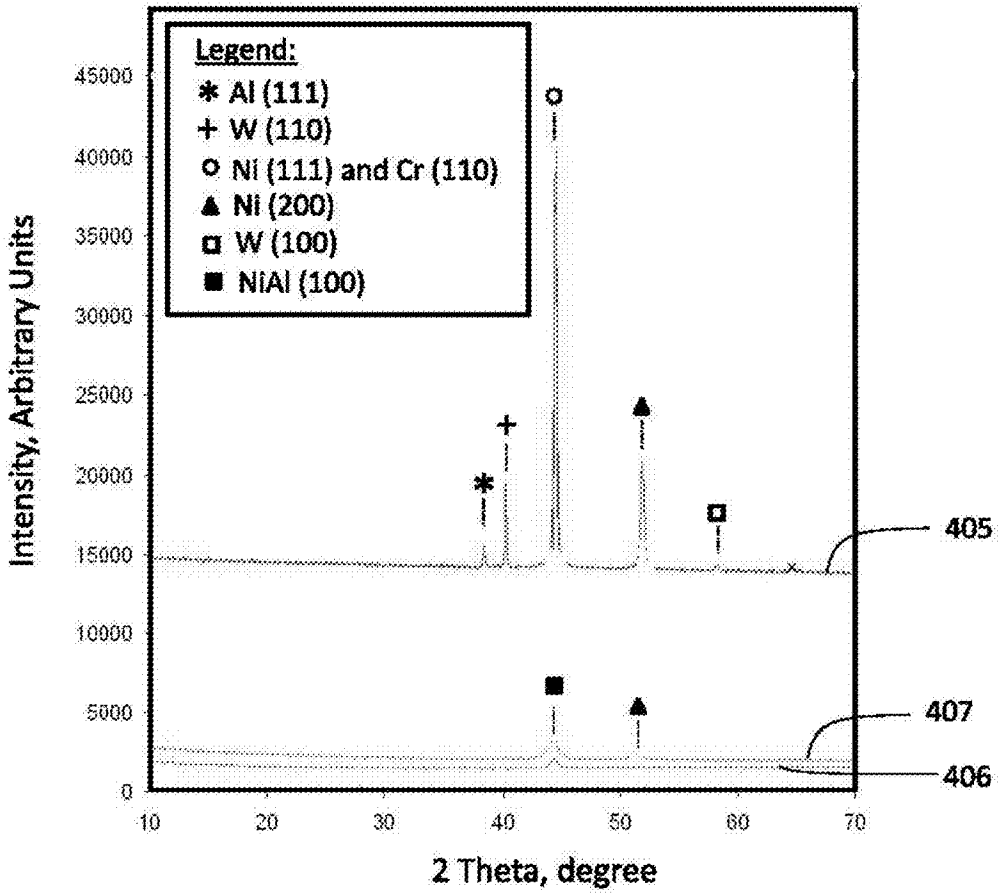
FIG. 4 illustrates an XRD analysis of coated host particles and composite particles generated by the methodology.

For example, FIG. 4 illustrates an XRD analysis comparing coated host particles before the high energy ball milling and composite particles following the high energy balling milling. At FIG. 4, coated host particles and ODS composite particles were generated according to this disclosure using a powder mixture comprised of coating particles of $Y_2O_3$, first host particles of Cr, and second host particles of Ni, with representative diameters of less than 50 nm for the $Y_2O_3$ particles, between 7.5-10 μm for the Cr particles, and between 4-8 μm for the Ni particles. Additionally, the powder mixture was comprised of Al and W particles between 4.5-7 μm. At FIG. 4, trace 405 represents the XRD pattern of the coated host particles prior to the high energy ball milling, and reflects XRD intensity peaks associated with the Cr first material and the Ni second material, as well as those associated with Al and W. The coated host particles are surrounded by an amorphous film of $Y_2O_3$ as discussed above, and corresponding peaks resulting from any $Y_2O_3$ crystalline structure are largely absent from trace 405. Similarly, trace 406 represents the XRD pattern generated after subjecting the coated host particles to the high energy ball milling process for a ball milling time period sufficient to generate the ODS composite particles. Trace 406 indicates a substantial absence in the XRD intensity peaks associated with the Cr first material, the Ni second material, and the Al and W, and indicates the formation of an intermetallic comprised of the Cr first material and the Ni second material. The substantial absence of the first material and second material peak intensities in the ODS composite particles indicates the sufficiency of the ball milling time period with respect to the necessary formation of the first and second material intermetallic in the ODS composite particles.

Additionally at FIG. 4, and to illustrate a primary advantage of the method disclosed, trace 407 illustrates an XRD analysis of commercially available ODS composite particles known as MA956 comprised of host particles and $Y_2O_3$ coating particles. The MA956 particles are typically fabricated largely through a high energy ball milling procedure without an initial MCB process as disclosed here. As illustrated, traces 407 and 406 indicate a similar absence of Cr and $Y_2O_3$ peak intensities. However, when generated by high energy ball milling without an initial MCB process, trace 407 typically requires on the order of 60 hours of high energy ball milling. Conversely, when preceded by an MCB process and generation of the coated particles as described here, trace 406 may be generated by high energy ball milling times as short as 2 hours. The method as disclosed here thus provides significant advantage in the fabrication of ODS composite particles.

As used here, the term "substantial absence" with respect to the composite particle XRD intensity peak means an XRD intensity peak which is either undetectable above background, or which reflects an intensity peak decrease of some percentage at the first host particle and second host particle 2-theta values, when compared to the XRD analysis of the coated host particles prior to the high energy ball milling process. For example, a substantial absence may mean that the XRD intensity peaks displayed at the 2-theta corresponding to the first and second materials decreases by at least 70% when an XRD analysis of the composite particles is compared to an XRD analysis of the coated host particles, where the intensity peak is the intensity above background, and where the intensity peaks compared may be height based intensities or area based intensities. Preferably, the XRD intensity peaks decrease at least 90%. The substantial absence of the previously present first and second material crystalline structures serves as indication that an intermetallic of the first and second materials is present within the composite particles.

Following high energy ball milling for a sufficient ball milling time period, the composite particles additionally have a representative diameter of from about 20 μm to about 100 μm, and have a grain size of less than one micron. The representative diameter of the composite particles may be determined by any suitable particle sizing method known in the art, including those sizing methods discussed supra. A sub-micron grain size means grains having an average diameter less than one micron. The grain size of the composite particles may similarly be determined by means known in the art, such as ASTM E 112, E 930, E 1181, E 1382, or other procedures as applicable.

The specific duration of the ball milling time period is generally not limiting within this disclosure, provided that the ball milling time period is sufficient to produce composite particles having a representative diameter of from about 20 μm to about 100 μm and having a grain size of less than one micron, where the composite particles are generally comprised of coating material originating from the coating particles dispersed within the grain boundaries and an intermetallic of the first material and the second material within the grains. Additionally, it is understood that although XRD methodologies may be utilized to verify the formation of composite particles as described here, other suitable means may be employed, including previous experience based on coated particles and powder mixtures of equivalent or similar composition.

As is understood, the fundamental process during high energy ball milling is the repeated welding, fracturing, and rewelding of a mixture of powder particles in a dry, highly energetic ball charge. This occurs under conditions in which the rates of welding and fracturing are generally in balance. The interplay of welding (with plastic deformation and agglomeration) and fracturing (size reduction) effectively kneads the internal structure of the composites so that the particles are continually refined and homogenized. Developing the balance between fracturing and cold welding may require different process modifications depending on the powder mixture. For example, special chemicals such as benzene, stearic acid, methanol, and others may be necessary for the mitigation of cold welding. See e.g. Benjamin, "Mechanical Alloying—A Perspective," *Metal Powder Report* 45 (2) (1990); see also Suryanarayana, *Mechanical Alloying and Milling*, Marcel Decker, New York, N.Y. (2004), among others. Further, as those skilled in the art understand, the controllable parameters of a typical high energy ball milling process, such as speed of impeller rotation, the number, size, and compositions of the milling balls, the atmosphere within the drum, the ratio of the weight of the powders to be milled to the weight of the balls, and other parameters is expected to impact the duration of the ball milling time period necessary for fabrication of the composite particles disclosed here.

Cold Spraying the Composite Particles:

The composite particles produced by this methodology may be applied to a substrate using a cold spray apparatus. As is understood, cold spray is a coating deposition method where solid powders generally less than 100 μm are accelerated in gas jets to velocities up to 500-1000 m/s using gas temperatures below the melting temperature of the particles. During impact with the substrate, the particles undergo plastic deformation and adhere to the surface. To achieve a uniform thickness the spraying nozzle is scanned along the substrate. Metals, polymers, and composite materials can be deposited using cold spraying. The kinetic energy of the particles, supplied by the expansion of the gas, is converted to plastic deformation energy during bonding. Unlike thermal spraying techniques such as plasma spraying, arc spraying, flame spraying, high velocity oxygen fuel, and others, the powders are not melted during the spraying process. In most cases, fine particle sizes are specified because only small particles reach the requested high velocities for particle deformation and bonding. The low temperatures of the process also permit spraying onto substrates containing temperature-sensitive materials. See e.g. Stoltenhoff et al., "An Analysis of the Cold Spray Process and Its Coatings," *Journal of Thermal Spray Technology,* 11(4) (2002); see also Papyrin et al., *Cold Spray Technology*, Elsevier Ltd., Oxford, UK (2007).

The composite particles generated by this method may be applied to a substrate using a cold spray process. This has particular advantage in certain embodiments of this disclosure, where the coating material is an oxide of yttria, zirconium, thorium, titanium, calcium, aluminium or hafnium, and the first or second material is nickel, chromium, cobalt, or iron, and the resulting composite particles are ODS composite particles. The ODS composite particles thus formed may be applied using cold spray techniques without destruction of the sub-micron grain size formed during the high energy ball milling process, and an oxide dispersion strengthened coating may result from subsequent heat treatment. This offers significant advantage over typical oxide strengthened dispersion methodologies, where hot isostatic pressing, hot extrusion, annealing and aging are employed after mechanical alloying by, for example, high energy ball milling.

Figure 5:
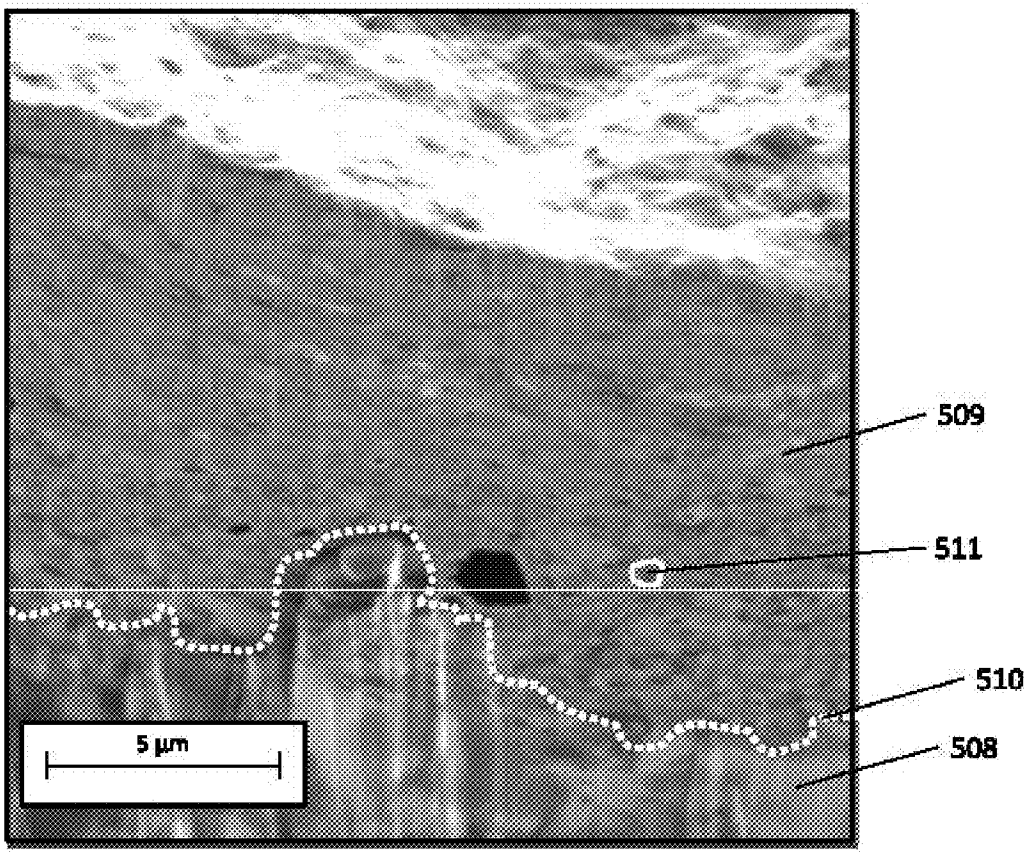
FIG. 5 illustrates an ODS layer on a substrate applied by cold spray.

In a particular embodiment, ODS composite particles are formed using a powder mixture comprised of $Y_2O_3$ coating particles with a representative diameter of less than 50 nm, Cr first host particles with a representative diameter between 7.5-10 μm, Ni second host particles with a representative diameter between 4-8 μm, and Al minor particles between 4.5-7 μm. The weight content of the powder mixture is from about 0.5 weight percent to about 2 weight percent $Y_2O_3$, from about 15 weight percent to about 25 weight percent Cr, from about 60 weight percent to about 80 weight percent Ni, and about 3 weight percent to about 7 weight percent Al. The coated host particles and ODS composite particles are fabricated using the methods disclosed, with an MCB time period of approximately 30 minutes and a ball milling time period of approximately 2 hours. The resulting ODS composite particles have a representative diameter of 40-60 μm with sub-micron grains, and are generally characterized by uniformly dispersed $Y_2O_3$ inside the grains acting as barriers to dislocation motion, and a mix of precipitate strengthened Cr and Ni intermetallics. The ODS composite particles may be cold sprayed onto a substrate without destruction of the sub-micron grain size. As an example, FIG. 5 illustrates the ODS composite particles of this particular embodiment applied to a substrate 508 producing ODS layer 509. The ODS layer-substrate boundary is indicated at 510. An exemplary grain structure within ODS layer 509 is indicated at 511, indicating by comparison to the 5 μm range provided that the sub-micron grain structure of the ODS composite particles is preserved following the cold spray application.

An exemplary cold spray apparatus utilizes a DYMET 403J cold spray system, Obninsk Center for Powder Spraying, Obninsk, RS, utilizing air at approximately 0.8 MPa as a supplying gas and a heating temperature of approximately 400° C., with a standoff distance between the nozzle and substrate of approximately 15 mm.

The ODS layer applied to the substrate may then be heat treated in order to form an oxide dispersion strengthened coating on the substrate.

Heat Treating the ODS Layer:

After cold spraying the ODS composite particles to generate the ODS layer on the substrate, the ODS layer may be heat treated to cause the sub-micron grain in the ODS layer to grow directionally into an elongated grain structure. The size of a typical elongated grain may be 5 to 50 μm, depending on the heat treatment. In an exemplary heat treatment, after any shaping process to achieve final or semi-final product configuration, the ODS layer is heat treated in the solid state by solution annealing at 1275-1300° C., for one hour followed by air cooling. The resulting layer is then hardened by heating in the range of about 925-1000° C. for about 1 to 12 hours, air cooling and then holding at a temperature of about 830-860° C. for 12 to 60 hours followed by air cooling.

Fabrication of Cooling Channels:

The heat treatment of the ODS layer results in the formation of an ODS coating on the substrate. As is known, oxide-dispersion strengthened alloys use uniformly distributed oxides to provide excessive strengthening at very high temperatures, and have been shown to exhibit high creep strength and excellent corrosion resistance. However, it is difficult to join the alloys because the dispersed oxides agglomerate, thus compromising the mechanical properties of the base material. An ongoing challenge has been to fabricate component systems and assemblies using oxide-dispersion strengthened alloys while preserving the dispersion microstructure during necessary joining operations. The strength benefits of ODS alloys are well known, but their use for full component fabrication has been extremely limited due to relatively high cost and difficulties in joining.

The ODS composite particle and cold spray methodologies disclosed here allow fabrication of oxide-dispersion strengthened coating having internal features such as cooling channels without reliance on joining methods which compromise mechanical properties. Such an internal feature could be fabricated by through the use of a fugitive phase that can be easily removed during post-processing, such as wax and graphite. With the fugitive phase in place, the ODS layer can then be applied via cold spraying or another deposition process that gives the desired ODS structure. Following deposition of the ODS layer, the fugitive phase may be removed. Such capability provides a means to embed cooling channels in an ODS coating external to the substrate on which the coating is applied, so that a significant amount of heat is removed before reaching the substrate. This permits the use of state-of-the-art superalloys and single crystal materials at higher temperatures.

Typical gas turbine engines include a compressor for compressing air, a combustor for mixing the compressed air with fuel and igniting the mixture, and a turbine blade assembly for producing power. Current gas turbine combustors often operate at high temperature exceeding 1500° C. (~2730° F.), and its exhaust imposes a great level of thermal loading on the turbine Made assembly downstream. Consequently, turbine blades and turbine vanes must be made of advanced materials with insulating coatings capable of withstanding such high temperatures and thermal loads. In addition, turbine blades and vanes often contain cooling systems for prolonging the life of these components and reducing the likelihood of thermo-mechanically induced failure. However, excessive use of cooling fluids from the compressor penalizes the efficiency of the turbine engine. Further, performance goals of modern gas turbine engines, both land-based and air-breathing engines, are aimed toward increasing the turbine inlet temperature (TIT) to levels as high as 1700° C. (~3090° F.) for utility turbines, and over 1900° C. (~3450° F.) for advanced military engines. This posts significant challenges for turbine development and needs for advanced thermal control and cooling strategies. The ODS composite particle and cold spray methodology disclosed here provides for placement of internal cooling passages in advantageous geometries, including adjacent to or as micro-channels within the ODS layer.

Figure 6:
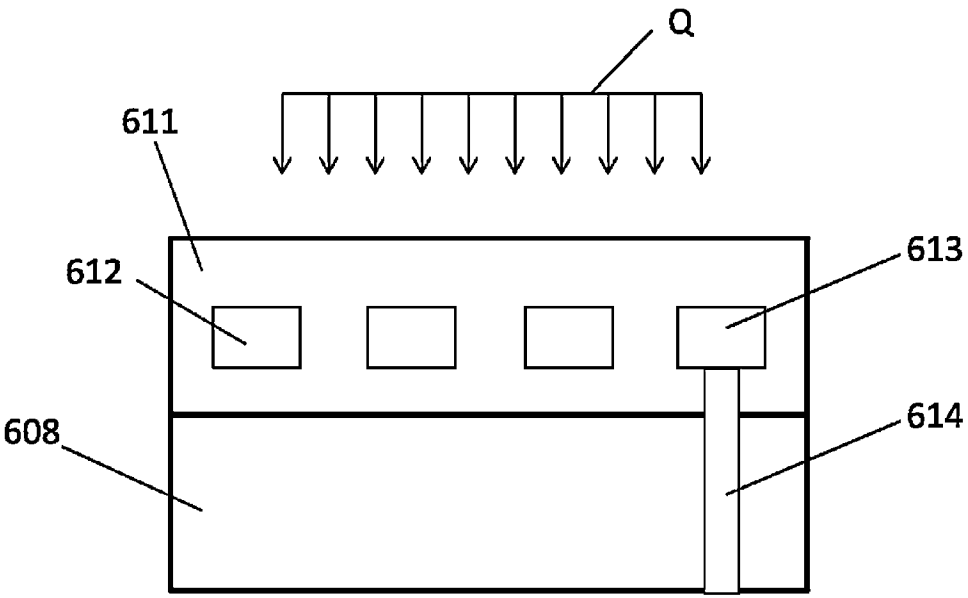
FIG. 6 illustrates an embodiment of a cooling channel within an ODS coating.

As an example, FIG. 6 illustrates a substrate 608 having an oxide dispersion strengthened coating 611 fabricated by application of the ODS composite particles disclosed, followed by heat treatment. Oxide dispersion strengthened coating 611 is comprised of cooling channels such as 612 through which a cooling fluid such as air may pass. Substrate 608 and ODS coating 611 are subject to an operating environment generating a heat flux Q impinging ODS coating 611 as illustrated, and the cooling channels such as 612 are in fluid communication with a source of cooling fluid. Under the conditions, substrate 608 is expected to reach a maximum steady-state temperature based on the impinging heat flux Q and the cooling provided by cooling channel 612. It is readily understood that for a given heat flux Q, the presence of cooling channels such as 612 reduces the maximum steady-state temperature achieved within substrate 608. It is further understood that for given substrate 608 temperature constraints, an increased heat flux Q can be tolerated. In a particular embodiment, a cooling channel 613 within ODS coating 611 receives a flow of cooling fluid from a substrate channel 614 originating from within substrate 608. Additionally, channels such as 612 or 613 may be fabricated in such a fashion that part of the cooling fluid is permitted to escape from the channel bulk through a porous TBC coating for transpiration cooling.

Figure 8:
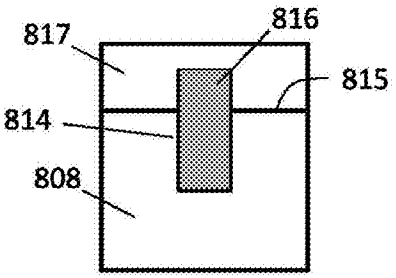
FIG. 8 illustrates an additional embodiment of a cooling channel within an ODS coating.
Figure 9:
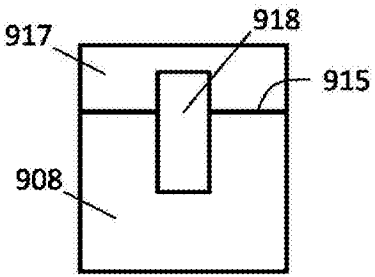
FIG. 9 illustrates an additional embodiment of a cooling channel within an ODS coating.
Figure 7:
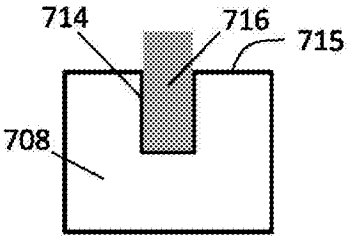
FIG. 7 illustrates an additional embodiment of a cooling channel within an ODS coating.

Processing of a component having an ODS layer that contains a cooling channel stemming from the underlying substrate can be achieved in various ways. One way is shown in FIG. 7. By means of investment casting or an additive manufacturing process, a component 708 (e.g., a turbine blade or vane) can be fabricated to have an air cooling channel 714 that extends to the surface 715 of component 708. For example, air cooling channel 714 could range from 100 to 1000 μm in size, with 100-500 μm being preferred. Air cooling channel 714 could then be filled with fugitive phase 716 that extends beyond surface 715 of component 708 in such a manner that air cooling channel 714 has an outcrop of fugitive phase 716 above surface 715. Fugitive phase 716 may be, for example, wax and graphite, both of which can be removed by heating. With the fugitive phase 716 in place, an ODS layer comprised of ODS composite particles would then be applied via cold spraying or any other deposition process that gives the desired ODS structure, as indicated at FIG. 8, illustrating component 808 having air cooling channel 814 extending to surface 815, with ODS layer 817 applied via cold spray and surrounding fugitive phase 816. The thickness of ODS layer 817 is greater than the height of the outcropped fugitive phase 816. Following deposition of the ODS layer, the fugitive phase would be removed to leave an extension of the air cooling channel into the ODS surface layer, as indicated at FIG. 9, illustrating component 908 having channel 918 extending through surface 915 and into ODS layer 917.

The disclosure is not limited to the specific order of steps recited above for the fabrication of air cooling channels, and variations may be utilized without departing from this disclosure. Within this disclosure, it is only necessary that a cold spray of ODS composite particles generates an ODS layer around a fugitive phase defining a cooling channel, and that the fugitive phase be subsequently removed. The resulting cooling channel may be incorporated wholly within the ODS layer, or a component such as component 908 may be fabricated or machined such the resultant cooling channel extends from component 908 through surface 915 and into ODS layer 917.

Figure 10:
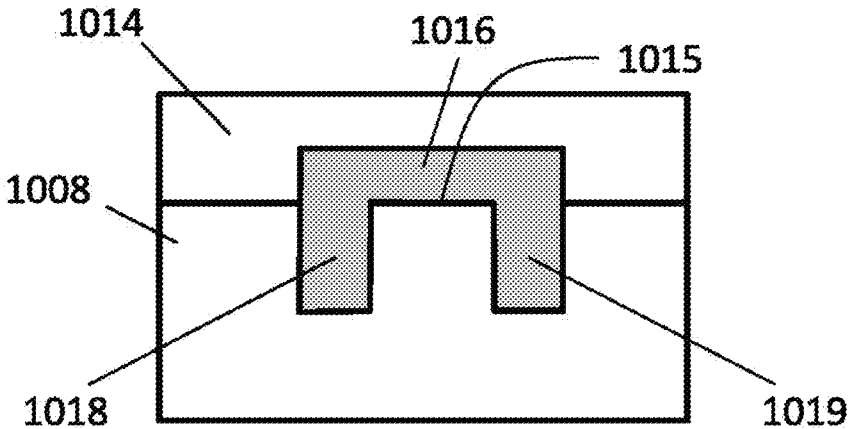
FIG. 10 illustrates an additional embodiment of a cooling channel within an ODS coating.

Alternately, as illustrated at FIG. 10, micro-channel designs can be configured multi-directionally to connect adjacent channels 1018 and 1019 using fugitive phase 1016 along the surface 1015 of the component 1008, followed by post-processing with subsequent fugitive material removal.

The ODS composite particle and cold spray methodology disclosed provides for placement of internal cooling passages in advantageous geometries and leads to enhanced cooling performance, in addition to alleviating manufacturing complexity as compared to double wall casting processes. Further, such a capability to imbed cooling microchannels within an ODS layer using the ODS composite particles and application methodology disclosed here provides the potential to eliminate the necessity for conventional oxidative protective bond coat systems. Implementation of the disclosed concept greatly enhances future turbine operating efficiency and reduces overall power plant and electricity costs Thus the disclosure provides a method for the fabrication of composite particles from a powder mix comprised of coating particles, first host particles, and second host particles. Within the powder mixture, the coating particles have a representative diameter of 50 nanometers (nm) or less, while the first host particle and the second host particle have representative diameters of from about 1 micron (μm) to about 50 μm. The method generates the composite particles utilizing a mechano chemical bonding process following by a high energy ball milling process. The composite particles formed have a representative diameter from about 20 μm to about 100 μm and have a grain size of less than one micron, where the grains are generally characterized by a uniformly dispersed coating material and a mix of first material and second material intermetallics.

The method disclosed lends itself to the fabrication of ODS composite particles which may be applied to a substrate via a cold spray process, with subsequent heat treatment to form an oxide dispersion strengthened coating. The ODS composite particles maintain their grain structure during the cold spray process and the oxide dispersion strengthened coating may be produced with a minimum of ball milling and without necessary hot rolling. In a particular embodiment, the resulting ODS composite particles are comprised of sub-micron grains generally characterized by uniformly dispersed Y2O3 inside the grains acting as barriers to dislocation motion, and a mix of precipitate strengthened Cr and Ni intermetallics. Further, the oxide dispersion-strengthened coating may act as a structural layer in concert with the underlying substrate, allowing feasible fabrication of cooling channels within the oxide dispersion-strengthened coating. The cooling channels may be formed through the use of a fugitive phase prior to the cold spray process, and removal of the fugitive phase following the heat treatment. Application of this particular embodiment through cold spray provides significant advantage over typical fabrication methodologies associated with nickel-based oxide dispersion-strengthened coatings.

It is to be understood that the above-described arrangements are only illustrative of the application of the principles of the present invention and it is not intended to be exhaustive or limit the invention to the precise form disclosed. Numerous modifications and alternative arrangements may be devised by those skilled in the art in light of the above teachings without departing from the spirit and scope of the present invention. It is intended that the scope of the invention be defined by the claims appended hereto.

In addition, the previously described versions of the present invention have many advantages, including but not limited to those described above. However, the invention does not require that all advantages and aspects be incorporated into every embodiment of the present invention.

All publications and patent documents cited in this application are incorporated by reference in their entirety for all purposes to the same extent as if each individual publication or patent document were so individually denoted.

What is claimed is:

1. A method of preparing composite particles comprising:

preparing a powder mixture comprised of coating particles, first host particles, and second host particles, where the coating particles consist of a coating material, and where the first host particles consist of a first material, and where the second host particles consist of a second material, where the first material and the second material are comprised of metals, and where a representative diameter of coating particles is about 50 nanometers or less, and where a representative diameter of the first host particles and a representative diameter of the second host particles is from about 1 micron to about 50 microns;

generating a coating of the coating material on the first host particles and on the second host particles by subjecting the powder mixture to a mechano chemical bonding process for an MCB time period, where the MCB time period is sufficient to generate the coating of the coating material, thereby generating coated host particles, where the coated host particles are comprised of a plurality of first host particles and a plurality of second host particles, where each first host particle in the plurality of first host particles is surrounded by the coating material, and where each second host particle in the plurality of second host particles is surrounded by the coating material; and subjecting the coated host particles to a high energy ball milling process for a ball milling time period sufficient to produce the composite particles, where the composite particles have a representative diameter of from about 20 microns to about 100 microns, and where the composite particles have a grain size of less than one micron, and where the composite particles are comprised of an intermetallic of the first material and the second material within the grain.

2. The method of claim 1 where the coating material is crystalline, and where the coated host particles have a substantial absence of a coating material XRD intensity peak, where the substantial absence of the coating material XRD intensity peak means an XRD intensity peak at the coating particle 2-theta value which is either undetectable above background, or an XRD intensity peak at the coating particle 2-theta value reflecting an intensity peak decrease of about 70 percent or more at the coating particle 2-theta value when compared to an XRD analysis of the coating particles or the powder mixture prior to the MCB process.

3. The method of claim 1 where the sufficiency of the MCB time period is determined using a visual means providing a direct observation of the coating of the coating material on the coated host particles.

4. The method of claim 2 where the first material is crystalline, and where the second material is crystalline, and where the composite particles have a substantial absence of a first material XRD intensity peak, where the substantial absence of the first material XRD intensity peak means either an XRD intensity peak at the first material 2-theta value which is either undetectable above background, or an XRD intensity peak at the first material 2-theta value reflecting an intensity peak decrease of about 70 percent or more at the first material 2-theta value when compared to an XRD analysis of the coated host particles prior to the high energy ball milling process, and where the composite particles have a substantial absence of a second material XRD intensity peak, where the substantial absence of the second material XRD intensity peak means either an XRD intensity peak at the second material 2-theta value which is either undetectable above background, or an XRD intensity peak at the second material 2-theta value reflecting an intensity peak decrease of about 70 percent or more at the second material 2-theta value when compared to the XRD analysis of the coated host particles prior to the high energy ball milling process.

5. The method of claim 4 where the coating material is an oxide of yttria, zirconium, thorium, titanium, calcium, aluminum, hafnium, or combinations thereof, and where the second material is nickel, cobalt, or iron.

6. The method of claim 5 where the coating material is yttrium-oxide, and where the first material is chromium, and where the second material is nickel, and where the powder mixture of further comprised of aluminum particles, where a representative diameter of the aluminum particles is from about 1 micron to about 50 microns.

7. The method of claim 6 where the powder mixture is comprised of from about 50 weight percent to about 90 weight percent nickel, and from about 10 weight percent to about 30 weight percent chromium, from about 0.5 weight percent to about 5 weight percent yttrium-oxide, and from about 1 weight percent to about 10 weight percent aluminum.

8. The method of claim 7 where the representative diameter of the first host particles and the representative diameter of the second host particles is from about 1 micron to about 20 microns, and where the MCB time period is less than 2 hours, and where the ball milling time period is from about 1 hour to about 15 hours.

9. The method of claim 1 further comprised of:

cold spraying the composite particles to a surface of a substrate, thereby generating a layered substrate; and heat treating the layered substrate at a heat treatment temperature and for a heat treatment time sufficient to generate a strengthened coating.

10. The method of claim 9 where the coating material is yttrium-oxide, and where the first material is chromium, and where the second material is nickel, and where the powder mixture is further comprised of aluminum particles, where a representative diameter of the aluminum particles is from about 1 micron to about 50 microns, and where the powder mixture is comprised of from about 50 weight percent to about 90 weight percent nickel, and from about 10 weight percent to about 30 weight percent chromium, from about 0.5 weight percent to about 5 weight percent yttrium-oxide, and from about 1 weight percent to about 10 weight percent aluminum, and where the strengthened coating is comprised of grains having a major diameter, where the major diameter is from about 5 microns to about 50 microns.

11. The method of claim 10 where the heat treatment temperature and the heat treatment time is comprised of;

solution annealing at an annealing temperature of from about 1250° C. to about 1400° C. for an annealing time of from about 1 hour to about 3 hours;

hardening at a hardening temperature of from about 900° C. to about 1050° C. for a hardening time of from about 1 hour to about 12 hours; and holding at a holding temperature of from about 800° C. to about 900° C. for a holding time of from about 12 hours to about 60 hours.

12. The method of claim 9 further comprised of:

constructing a micro-channel prior to the cold spraying step by placing a fugitive phase material on a micro-channel footprint, where the micro-channel footprint is a portion of the surface of the substrate;

conducting the cold spraying step; and removing the fugitive phase material from the layered substrate.

13. The method of claim 12 where the substrate is comprised of a cooling channel in fluid communication with the micro-channel footprint.

14. A method of preparing ODS composite particles for a oxide-dispersion strengthened coating on a substrate comprising:

preparing a powder mixture comprised of comprised of oxide coating particles, first host particles, and second host particles, where the oxide coating particles consist of an oxide coating material, where the oxide coating material is comprised of an oxide of yttria, zirconium, thorium, titanium, calcium, aluminum, hafnium, or combinations thereof, and where the first host particles consist of a first material, where the first material is comprised of a metal, and where the second host particles consist of a second material, where the second material is nickel, cobalt, or iron, and where a representative diameter of oxide coating particles is about 50 nanometers or less, and where a representative diameter of the first host particles and a representative diameter of the second host particles is from about 1 micron to about 50 microns;

generating a coating of the oxide coating material on the first host particles and on the second host particles by subjecting the powder mixture to a mechano chemical bonding process for an MCB time period, where the MCB time period is less than 2 hours, thereby generating oxide coated host particles, where the oxide coated host particles are comprised of a plurality of first host particles and a plurality of second host particles, where each first host particle in the plurality of first host particles is surrounded by the oxide coating material, and where each second host particle in the plurality of second host particles is surrounded by the oxide coating material; and subjecting the oxide coated host particles to a high energy ball milling process for a ball milling time period, and where the ball milling time period is from about 1 hour to about 15 hours, thereby generating the ODS composite particles, where the ODS composite particles have a representative diameter of from about 20 microns to about 100 microns, and where the ODS composite particles are comprised of a plurality of grains having a grain size of less than one micron, and where the plurality of grains are comprised of an intermetallic of the first material and the second material and a dispersion of the oxide material.

15. The method of claim 14 further comprised of:

cold spraying the ODS composite particles to a surface of a substrate, thereby generating an ODS layered substrate; and heat treating the ODS layered substrate at a heat treatment temperature and for a heat treatment time sufficient to generate the oxide-dispersion strengthened coating, where the oxide-dispersion strengthened coating is comprised of grains having a major diameter, where the major diameter is from about 5 microns to about 50 microns.

16. The method of claim 15 further comprised of:

constructing a micro-channel prior to the cold spraying step by placing a fugitive phase material on a micro-channel footprint, where the micro-channel footprint is a portion of the surface of the substrate;

conducting the cold spraying step; and removing the fugitive phase material from the ODS layered substrate.

17. The method of claim 15 where the coating material is yttrium-oxide, and where the first material is chromium, and where the second material is nickel, and where the powder mixture is further comprised of aluminum particles, where a representative diameter of the aluminum particles is from about 1 micron to about 50 microns, and where the powder mixture is comprised of from about 50 weight percent to about 90 weight percent nickel, and from about 10 weight percent to about 30 weight percent chromium, from about 0.5 weight percent to about 5 weight percent yttrium-oxide, and from about 1 weight percent to about 10 weight percent aluminum.

18. The method of claim 17 where the heat treatment temperature and the heat treatment time is comprised of:

solution annealing at an annealing temperature of from about 1250° C. to about 1400° C. for an annealing time of from about 1 hour to about 3 hours;

hardening at a hardening temperature of from about 900° C. to about 1050° C. for a hardening time of from about 1 hour to about 12 hours; and holding at a holding temperature of from about 800° C. to about 900° C. for a holding time of from about 12 hours to about 60 hours.

19. A method of preparing ODS composite particles for a oxide-dispersion strengthened coating on a substrate comprising:

preparing a powder mixture comprised of comprised of oxide coating particles, first host particles, second host particles, and minor particles, where the oxide coating particles are comprised of yttrium-oxide, and where the first host particles are comprised of chromium, and where the second host particles are comprised of nickel, and where the minor particles are comprised of aluminum, and where a representative diameter of oxide coating particles is about 50 nanometers or less, and where a representative diameter of the first host particles is from about 1 micron to about 20 microns, and where a representative diameter of the second host particles is from about 1 micron to about 20 microns, and where a representative diameter of the minor particles is from about 1 micron to about 20 microns, and where the powder mixture is comprised of from about 50 weight percent to about 90 weight percent nickel, and from about 10 weight percent to about 30 weight percent chromium, from about 0.5 weight percent to about 5 weight percent yttrium-oxide, and from about 1 weight percent to about 10 weight percent aluminum;

generating a coating of the yttrium-oxide on the first host particles and on the second host particles by subjecting the powder mixture to a mechano chemical bonding process for an MCB time period, where the MCB time period is less than 2 hours, thereby generating oxide coated host particles, where the oxide coated host particles are comprised of a plurality of first host particles and a plurality of second host particles, where each first host particle in the plurality of first host particles is surrounded by yttrium-oxide, and where each second host particle in the plurality of second host particles is surrounded by yttrium-oxide;

subjecting the oxide coated host particles to a high energy ball milling process for a ball milling time period, and where the ball milling time period is from about 1 hour to about 15 hours, thereby generating the ODS composite particles, where the ODS composite particles have a representative diameter of from about 20 microns to about 100 microns, and where the ODS composite particles are comprised of a plurality of grains having a grain size of less than one micron, and where the plurality of grains are comprised of an intermetallic of chromium and nickel and a dispersion of yttrium-oxide;

cold spraying the ODS composite particles to a surface of a substrate, thereby generating an ODS layered substrate; and heat treating the ODS layered substrate at a heat treatment temperature and for a heat treatment time sufficient to generate the oxide-dispersion strengthened coating, where the oxide-dispersion strengthened coating is comprised of grains having a major diameter, where the major diameter is from about 5 microns to about 50 microns.

20. The method of claim 19 further comprised of:

constructing a micro-channel prior to the cold spraying step by placing a fugitive phase material on a micro-channel footprint, where the micro-channel footprint is a portion of the surface of the substrate;

conducting the cold spraying step and removing the fugitive phase material from the ODS layered substrate; and performing the heat treating step.

* * * * *